US006745712B1

(12) United States Patent
Fujinaga et al.

(10) Patent No.: US 6,745,712 B1
(45) Date of Patent: Jun. 8, 2004

(54) FULLY ROTATABLE SHUTTLE

(75) Inventors: Naoji Fujinaga, Chiyoda-ku (JP); Nozomi Hoshina, Chiyoda-ku (JP); Yoshifumi Nishizawa, Chiyoda-ku (JP); Hiromitsu Shimizu, Osaka (JP); Zengo Tsukuda, Osaka (JP)

(73) Assignees: Mitsubishi Denki Kabushiki Kaisha, Tokyo (JP); Hirose Manufacturing Co., Ltd., Osaka (JP)

( * ) Notice: Subject to any disclaimer, the term of this patent is extended or adjusted under 35 U.S.C. 154(b) by 0 days.

(21) Appl. No.: 09/979,885

(22) PCT Filed: May 28, 1999

(86) PCT No.: PCT/JP99/02867

§ 371 (c)(1),
(2), (4) Date: Feb. 20, 2003

(87) PCT Pub. No.: WO00/73566

PCT Pub. Date: Dec. 7, 2000

(51) Int. Cl.[7] ..... D05B 57/26
(52) U.S. Cl. ..... 112/181; 112/231
(58) Field of Search ..... 112/181, 227, 112/228, 231, 230, 196

(56) References Cited

U.S. PATENT DOCUMENTS 1,504,241 A * 8/1924 Hohmqann ..... 112/231
2,348,718 A * 5/1944 Bethune et al. ..... 112/196
4,393,798 A * 7/1983 Cheng ..... 112/231
RE32,809 E * 12/1988 Hirose ..... 112/231
5,076,182 A * 12/1991 Hirose et al. ..... 112/228
5,188,046 A * 2/1993 Badillo ..... 112/231

FOREIGN PATENT DOCUMENTS

| | | |
|---|---|---|
| JP | 34-10981 | 12/1959 |
| JP | 48-46861 | 6/1973 |
| JP | 49-19427 | 5/1974 |
| JP | 59-49824 | 12/1984 |
| JP | 10-290894 | 11/1998 |

* cited by examiner

*Primary Examiner*—Ismael Izaguirre
(74) *Attorney, Agent, or Firm*—Wenderoth, Lind & Ponack, L.L.P.

(57) ABSTRACT

A shuttle body 3 having aloop seizing beak 10 for seizing a needle thread 9 is rotatably attached to a shuttle race body 2, pressed by a driver 4, and continuously rotated in a rotation direction B in synchronization with vertical motion of a needle 8. A bobbin case 5 in which a bobbin thread 12 wound around a bobbin 5 is accommodated is attached to the shuttle body 3. Under a state where the bobbin thread 12 is pulled out from the bobbin case 5, the shuttle body 3 is rotated, the needle thread 9 is seized by the loop seizing beak 10, the loop of the needle thread 9 is expanded along the outer face of the shuttle body 3, the loop of the needle thread 9 is passed over the shuttle body 3 and the bobbin case 5 so that the shuttle body 3 and the bobbin case 5 are passed through the loop of the needle thread 9, whereby the needle thread 9 is wound around the bobbin thread 12 and a stitch can be formed.

4 Claims, 7 Drawing Sheets

FULLY ROTATABLE SHUTTLE

TECHNICAL FIELD

The present invention relates to a full rotary hook which is disposed in a domestic sewing machine, an industrial sewing machine or the like.

BACKGROUND ART

A typical horizontal full rotary hook of the conventional art has a loop taker which is rotated about a rotation axis perpendicular to the axis of a movement path of a needle that is vertically reciprocated; an bobbin case holder which is attached to the inside of the loop taker; a bobbin case which is detachably attached to the inside of the bobbin case holder; and a bobbin around which a bobbin thread is wound and which is then attached to the inside of the bobbin case.

The loop taker has a peripheral wall having a loop seizing beak for seizing a needle thread passed through a needle, and a track groove formed in an inner peripheral portion thereof; a bottom wall connected to one axial end portion of the peripheral wall so as to be perpendicular thereto; and a boss which is integrally formed with the bottom wall so as to be protruded from the bottom wall toward the side opposite to the peripheral wall and is fixed to the lower axis of a sewing machine with being positioned in the circumferential direction. In order to avoid interference with the inserted needle, a notch is formed in the peripheral wall of the loop taker to divide the loop taker in the circumferential direction. The loop seizing beak is formed in one circumferential end portion which is an end portion on the downstream side in the rotation direction of the loop taker.

The bobbin case holder has a peripheral wall having a track projection formed on the outer periphery thereof; a bottom connected to one axial end of the peripheral wall so as to be perpendicular thereto; a flange connected continuously projected in the radial direction outwardly from the other axial end of the peripheral wall; and a stud standing from the center of the bottom to the open end of the inner bobbin case so as to be perpendicular to the bottom. In order to enable the thread passing which will be described later, the track projection is divided along the circumferential direction in the region where the needle is to be inserted. A holder stop recess is formed in the flange. The bobbin case holder is attached to the loop taker under a state where the bottom is placed on the loop taker bottom wall side. The track projection is fitted into the track groove of the loop taker, and the bobbin case holder is rotatably supported with respect to the loop taker. A projection of a holder stop member fixed to the body of the sewing machine is fitted into the holder stop recess, thereby preventing the bobbin case holder from being rotated in accordance with the rotation of the loop taker, in the same direction.

The bobbin case has a peripheral wall on which a bobbin thread tension spring is disposed, and an end wall perpendicularly which is perpendicularly continuous from one axial end of the peripheral wall, and in which a latch mechanism is disposed. Under a state where the bobbin around which the bobbin thread is wound is accommodated, the bobbin case is engagingly attached to the stud of the bobbin case holder by the latch mechanism. The bobbin thread accommodated in the bobbin case is pulled out from the bobbin, passed between the peripheral wall of the bobbin case and the bobbin thread tension spring, and then guided to the upper side through the open end of the bobbin case holder.

The horizontal full rotary hook is configured in the following manner. The loop taker is rotated about the rotation axis, the needle thread supplied by the needle which is reciprocated in synchronization with the rotation of the loop taker is seized by the loop seizing beak, and a loop of the needle thread is passed over the periphery while being expanded along the outer face of the bobbin case holder, thereby performing the thread passing so as to cause the bobbin case holder to pass through the loop of the needle thread. The needle thread is wound around the bobbin thread pulled out from the bobbin. Under this state, the needle thread is pulled up due to an upward motion of a thread take-up lever (not shown), whereby sewing a workpiece on a throat plate is allowed.

Another typical conventional art is an oscillating loop taker which has: a shuttle race body which is fixed to the body of a sewing machine; a shuttle body which is attached to the inside of the shuttle race body; a driver which is swung about a rotation axis perpendicular to the axis of a needle that is vertically reciprocated; a bobbin case which is detachably attached to the inside of the shuttle body; and a bobbin around which a bobbin thread is wound and which is then attached to the inside of the bobbin case.

In the shuttle race body, a track groove which elongates in the circumferential direction is formed in an inner peripheral portion. The shuttle body has: a peripheral wall which elongates along a semi-arc; a bottom wall which is continuous from one axial end portion of the peripheral wall; and a stud which protrudes from the bottom wall toward the other axial end of the peripheral wall. A track projection is fitted into the track groove of the shuttle race body, and the shuttle body is rotatably supported with respect to the shuttle race body.

The driver has the driver body which elongates along a semi-arc, and a boss which is formed integrally with the driver body, and which is fixed to a lower shaft of the sewing machine with being positioned in the circumferential direction. The driver is configured so that the driver body is placed at a position which is shifted by about 180 deg. with respect to the shuttle body in the shuttle race body, and the circumferential ends of the driver body can press the circumferential ends of the peripheral wall of the shuttle body, respectively.

The bobbin case has a peripheral wall on which a bobbin thread tension spring is disposed, and an end wall which is perpendicularly continuous from one axial end of the peripheral wall, and in which a latch mechanism is disposed. Under a state where the bobbin around which the bobbin thread is wound is accommodated, the bobbin case is engaged with the stud of the shuttle body by the latch mechanism so as to be rotatably attached to the shuttle body. The bobbin case is prevented by the shuttle race body from being rotated in accordance with the rotation of the shuttle body. The needle thread accommodated in the bobbin case is pulled out from the bobbin, passed between the peripheral wall of the bobbin case and the bobbin thread tension spring, and then guided to the upper side through the other end side in the axial direction of the shuttle body.

The oscillating loop taker is configured in the following manner. The driver is swung so as to make a half rotation around the rotation axis. The shuttle body is pressed by the driver to be swung between a position where a loop seizing beak is placed upwardly, and that where the loop seizing beak is placed downwardly. The needle thread supplied by the needle which is reciprocated in synchronization with the swing operation of the shuttle body is seized by the loop seizing beak, and a loop of the needle thread is passed over the periphery of the shuttle body while being expanded along the outer face of the shuttle body, thereby causing the loop of the needle thread to be passed over the periphery of the bobbin case to perform the thread passing. The needle thread is wound around the bobbin thread pulled out from the bobbin. Under this state, the needle thread is pulled up due to an upward motion of a thread take-up lever (not shown), whereby sewing a workpiece on a throat plate is allowed.

In the horizontal full rotary hook of the conventional art, the loop of the needle thread is passed over the bobbin case holder by the loop taker on which the loop seizing beak is formed, in such a manner that the loop is passed over the periphery of the bobbin case holder to which the bobbin case is attached. The loop taker for seizing the needle thread and moving the loop of the needle thread is fixed to the lower shaft of the sewing machine, and hence cannot be passed through the loop of the needle thread. The loop of the needle thread is wound around a thread separating portion which is an end portion of the track projection on the upstream side in the rotation direction of the loop taker. The two thread portions of the loop of the needle thread which vertically elongate are separated into the bottom side and open end side of the bobbin case holder, respectively, and passed over the bobbin case holder.

When the lowest end of the loop of the needle thread is passed over the lowest end of the bobbin case holder, a thread portion which upwardly elongates from the loop taker open end side of the loop-seizing-beak-forming-portion where the loop seizing beak is formed, immediately after the thread is seized by the loop seizing beak elongates toward the bottom of the bobbin case holder, and another thread portion which upwardly elongates from the loop taker bottom side of the loop-seizing-beak-forming-portion immediately after the thread is seized by the loop seizing beak elongates toward the open end of the bobbin case holder. Therefore, the loop of the needle thread is passed over the bobbin case holder under a state where the loop crosses above the bobbin case holder. As described above, in the horizontal full rotary hook in which the loop taker for moving the needle thread cannot be passed through the loop of the needle thread, the loop of the needle thread crosses above the bobbin case holder when the loop is passed over the bobbin case holder, and hence the needle thread is easily twisted.

In the oscillating loop taker of the conventional art, the loop of the needle thread is passed over the bobbin case by the shuttle body on which the loop seizing beak is formed. The shuttle body which seizes the needle thread and moves the loop of the needle thread is formed separately from the driver which is fixed to the lower shaft of the sewing machine, and hence can be passed through the loop of the needle thread. The two thread portions of the loop of the needle thread which vertically elongate are separated into the bottom side and open end side of the shuttle body, respectively, and the shuttle body is passed through the loop of the needle thread. In accordance with this, the thread passing is performed so that the bobbin case is passed through the loop of the needle thread.

In the thus configured oscillating loop taker, when the lowest end of the loop of the needle thread is passed over the lowest end of the bobbin case, a thread portion which upwardly elongates from the shuttle body open end side of the loop-seizing-beak-forming-portion where the loop seizing beak is formed, immediately after the thread is seized by the loop seizing beak elongates toward the open end of the shuttle body, and another thread portion which upwardly elongates from the shuttle body bottom side of the loop-seizing-beak-forming-portion immediately after the thread is seized by the loop seizing beak elongates toward the open end of the shuttle body. Therefore, the loop of the needle thread is passed over the shuttle body and the bobbin case with being expanded into a substantially U-like shape without crossing in an Intermediate portion. In the oscillating loop taker in which the shuttle body for moving the needle thread can be passed through the loop of the needle thread as described above, the loop of the needle thread does not cross unlike the above-described horizontal full rotary hook, and hence the needle thread is not twisted.

In the oscillating loop taker which can solve the problem of the horizontal full rotary hook, since the driver which presses the shuttle body is rotated so as to make a half rotation, and the driver must stop two times during an operation of one cycle, and hence it is difficult to improve the operation speed.

Therefore, it is an object of the invention to provide a full rotary hook which enables a needle thread to be wound around a bobbin thread without being twisted, and which can improve the operation speed.

DISCLOSURE OF INVENTION

The invention set forth in claim 1 is a full rotary hook comprising:

a shuttle race body which is fixed to a body of a sewing machine and has a track groove formed on an inner peripheral portion of the shuttle race body so as to circumferentially elongate in a circumferential direction thereof;

a shuttle body having a track projection elongating in the circumferential direction and being divided in the circumferential direction, formed on an outer peripheral portion, which track projection is fitted into the track groove to rotatably attach the shuttle body to the shuttle race body, and in which a loop-seizing-beak-forming-portion is formed, the loop-seizing-beak-forming-portion including a loop seizing beak formed at a tip end thereof, for seizing a needle thread supplied by a needle which is vertically reciprocated;

a driver which is continuously rotated in synchronization with a vertical motion of the needle in a predetermined rotation direction, for rotating the shuttle body about an axis of the shuttle body by pressing the shuttle body by rotation of the driver; and a bobbin case for accommodating bobbin thread, being detachably attached to the shuttle body, wherein the loop-seizing-beak-forming-portion is formed so as to protrude in a rotation direction of the shuttle body from one circumferential end of the track projection which is placed on a downstream side in the rotation direction of the shuttle body, in the shuttle race body, a protrusion which protrudes in an axial direction of the shuttle race body so as to face the track groove is formed, and a recess which extends in the circumferential direction is formed on a radial outer side of the protrusion, the track projection of the shuttle body has an inner peripheral portion and an outer peripheral portion, the outer peripheral portion more protruding toward an open end of the shuttle body than the inner peripheral portion, a protrusion being formed by the outer peripheral portion, and a recess which elongates in the circumferential direction being formed on a radial inner side of the protrusion, the protrusion of the shuttle race body is fitted into the recess of the track projection of the shuttle body, the protrusion of the shuttle body being fitted into the recess of the shuttle race body, and engaged with the protrusion of the shuttle race body from a radial outer side of the shuttle body, in the outer peripheral portion of the track projection, a projection amount with respect to the inner peripheral portion in regions near circumferential ends is smaller than a projection amount with respect to the inner peripheral portion in a region of a circumferential intermediate portion which is between the regions near the circumferential ends, and the loop seizing beak is formed in a plane including an end face on a shuttle body open end side in the region of the circumferential intermediate portion of the outer peripheral portion of the track projection, and the loop-seizing-beak-forming portion which more protrudes toward the shuttle body open end than the regions near the circumferential ends of the outer peripheral portion of the track projection is passed through a recess formed in the needle.

According to the invention, the shuttle body having the loop seizing beak for seizing the needle thread is attached to the shuttle race body to be rotatable, pressed by the driver, and continuously rotated in the predetermined rotation direction in synchronization with the vertical motion of the needle. The bobbin case accommodating the bobbin thread is attached to the shuttle body. Under a state where the bobbin thread is pulled out from the bobbin case, the shuttle body is rotated, the needle thread is seized by the loop seizing beak, the loop of the needle thread is expanded along the outer face of the shuttle body, and the loop of the needle thread is passed over the bobbin case so that the bobbin case is passed through the loop of the needle thread, whereby the needle thread is wound around the bobbin thread and a stitch can be formed. The shuttle body which seizes the needle thread and moves the loop of the needle thread while expanding the loop is rotated by the driver which is separately formed. When the loop of the needle thread is to be passed over the bobbin case, therefore, the loop can be passed over the shuttle body. Consequently, the loop of the needle thread can perform the thread passing under a state where the loop is expanded into a substantially U-like shape without crossing in an intermediate portion, and the needle thread is wound around the bobbin thread without forming a twist. Furthermore, the driver is continuously rotated in a predetermined rotation direction, and in accordance with the rotation, the shuttle body is continuously rotated. The driver and the shuttle body do not stop during an operation of one cycle, and hence the full rotary hook can be operated at a high speed.

The track projection has the inner peripheral portion and the outer peripheral portion, and the outer peripheral portion protrudes toward the shuttle body open end with respect to the inner peripheral portion to form the protrusion. In the outer peripheral portion of the track projection, the projection amount with respect to the inner peripheral portion in the regions near the circumferential ends is smaller than the projection amount with respect to the inner peripheral portion in the region of the circumferential intermediate portion which is between the regions near the circumferential ends. The loop-seizing-beak-forming-portion is formed so as to protrude in the rotation direction of the shuttle body from the one circumferential end of the track projection which is placed on the downstream side in the rotation direction of the shuttle body. The loop-seizing-beak-forming-portion functions also as the track projection which is fitted into the track groove. The loop seizing beak formed at the tip end of the loop-seizing-beak-forming-portion is formed in the plane including the end face on the shuttle body open end side in the region of the circumferential intermediate portion of the outer peripheral portion of the track projection.

As described above, the regions near the circumferential ends of the outer peripheral portion of the track projection are formed so as to have a small width and a small projection amount toward the shuttle body open end. According to this configuration, the needle which is vertically moved in the vicinity of the track projection is prevented from interfering with the shuttle body. Although the loop seizing beak is formed in the plane including the end face on the shuttle body open end side in the region of the circumferential intermediate portion of the outer peripheral portion of the track projection, and the loop-seizing-beak-forming-portion protrudes toward the shuttle body open end, the loop-seizing-beak-forming-portion is passed through the recess formed in the needle, and hence does not interfere with the needle.

In the shuttle race body, the protrusion is formed so as to protrude toward the track groove, and the recess is formed on the radial outer'side of the protrusion. In the track projection of the shuttle body, the protrusion is formed by the outer peripheral portion, and the recess is formed on the radial inner side of the protrusion. The protrusion of the shuttle race body is fitted into the recess of the track projection of the shuttle body, and the protrusion of the track projection of the shuttle body is fitted into the recess of the shuttle race body, and engaged with the protrusion of the shuttle race body from the radial outer side. Under this state, the track projection of the shuttle body is fitted into the track groove of the shuttle race body. The track projection of the shuttle body, in which the projection amount in the regions near the circumferential ends of the outer peripheral portion of the track projection is formed so as to be small in order to avoid interference with the needle, is guided by the portion facing the track groove of the shuttle race body, and the shuttle body is rotatable about its axis. Furthermore, the shuttle body is prevented from vibrating in a radial direction during rotation, and can be stably rotated.

The invention set forth in claim 2 is characterized in that, in the configuration of the invention set forth in claim 1, the shuttle body has a spring member which is fixed in a vicinity of a basal end, and the driver presses a free end of the spring member or a vicinity of the free end.

According to the invention, the driver presses the free end of the spring member of the shuttle body or the vicinity of the free end, the rotation force of the driver is transmitted to the shuttle body via the spring member, and the shuttle body is rotated. As a result, when the driver is continuously rotated, the spring member periodically repeats an elastically deforming operation and an operation of recovering the elastic deformation. This causes the driver and the free end of the spring member or the vicinity of the free end to periodically abut against and separate from each other. When the loop of the needle thread is to be passed over the shuttle body, the loop can be passed through the gap between the driver and the free end of the spring member or the vicinity of the free end during a period when the driver and the free end of the spring member or the vicinity of the free end are separated from each other. When the loop of the needle thread is to perform the thread passing, therefore, the needle thread can be prevented from being pressed between the shuttle body and the driver to be caught thereby, and the loop of the needle thread can smoothly perform the thread passing. Even when the needle thread is accidentally pressed between the shuttle body and the driver, the needle thread elastically deforms the spring member and can be then passed between the driver and the spring member. Therefore, a breakage of the needle thread does not occur.

The invention set forth in claim 3 is characterized in that, in the configuration of the invention set forth in claim 1, a rotation axis of the driver is eccentric with respect to a rotation axis of the shuttle body.

According to the invention, the eccentricity between the rotation axes of the driver and the shuttle body causes the position where the driver presses the shuttle body to be changed in the radial direction of the shuttle body, so that the torque transmitted from the driver to the shuttle body is periodically changed. As a result, at a time when the torque is low, the loop of the needle thread is allowed to pass between the driver and the shuttle body.

The invention set forth in claim 4 is characterized in that, in the configuration of the invention set forth in claim 1, the shuttle body has a peripheral wall on which the track projection is formed, and a needle drop hole is formed in a region of the peripheral wall where the needle is to be inserted.

According to the invention, the shuttle body has the peripheral wall on which the track projection is formed, and the loop of the needle thread seized by the loop seizing beak is moved along the periphery of the shuttle body while being guided and expanded by the peripheral wall, so that the loop of the needle thread can be easily passed over the shuttle body and the bobbin case. The needle drop hole into which the needle is to be inserted is formed in the peripheral wall, thereby preventing the needle and the shuttle body from interfering with each other.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
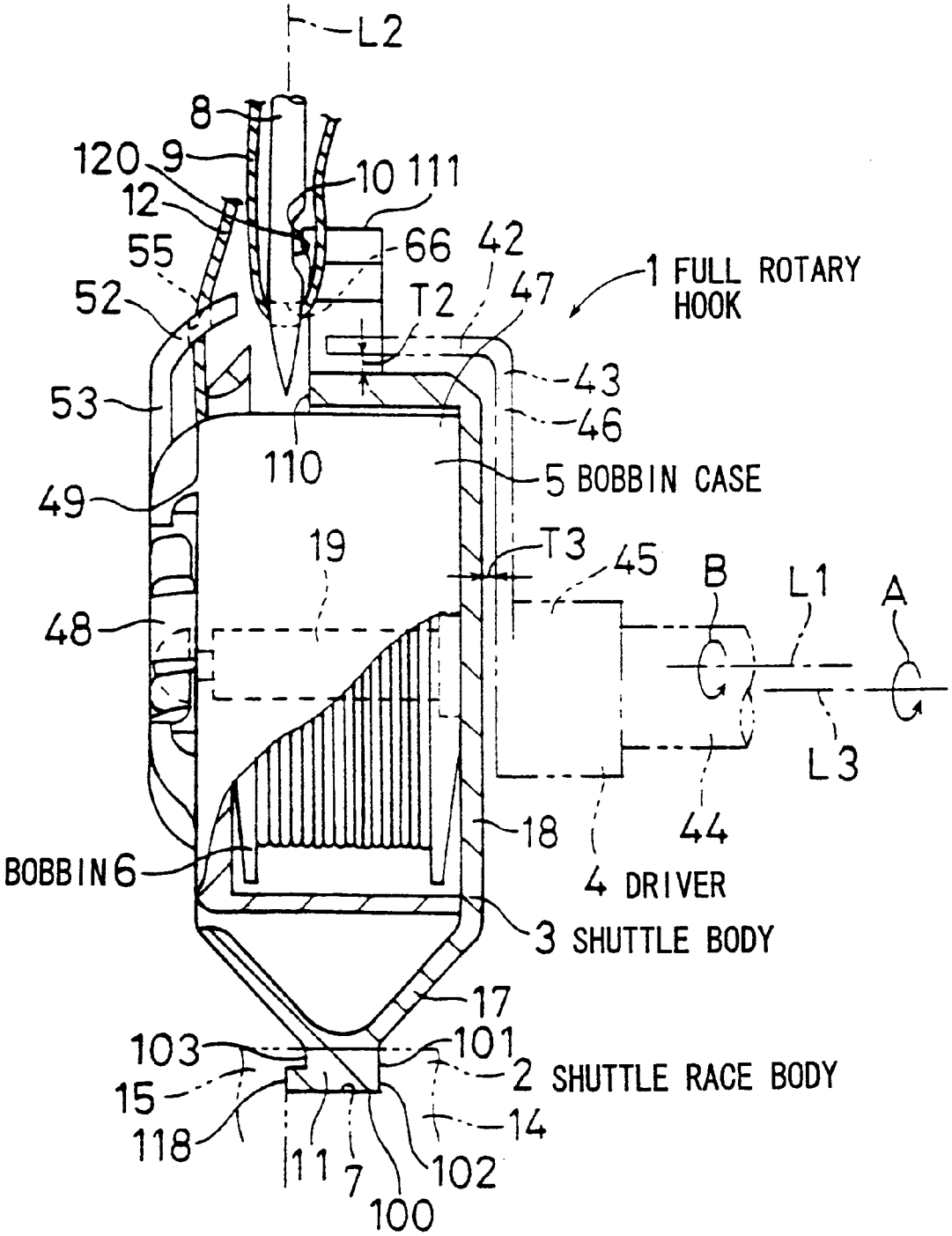
FIG. 1 is a section view showing a full rotary hook 1 of an embodiment of the invention.

Now referring to the drawings, preferred embodiments of the invention are described below.

Figure 2:
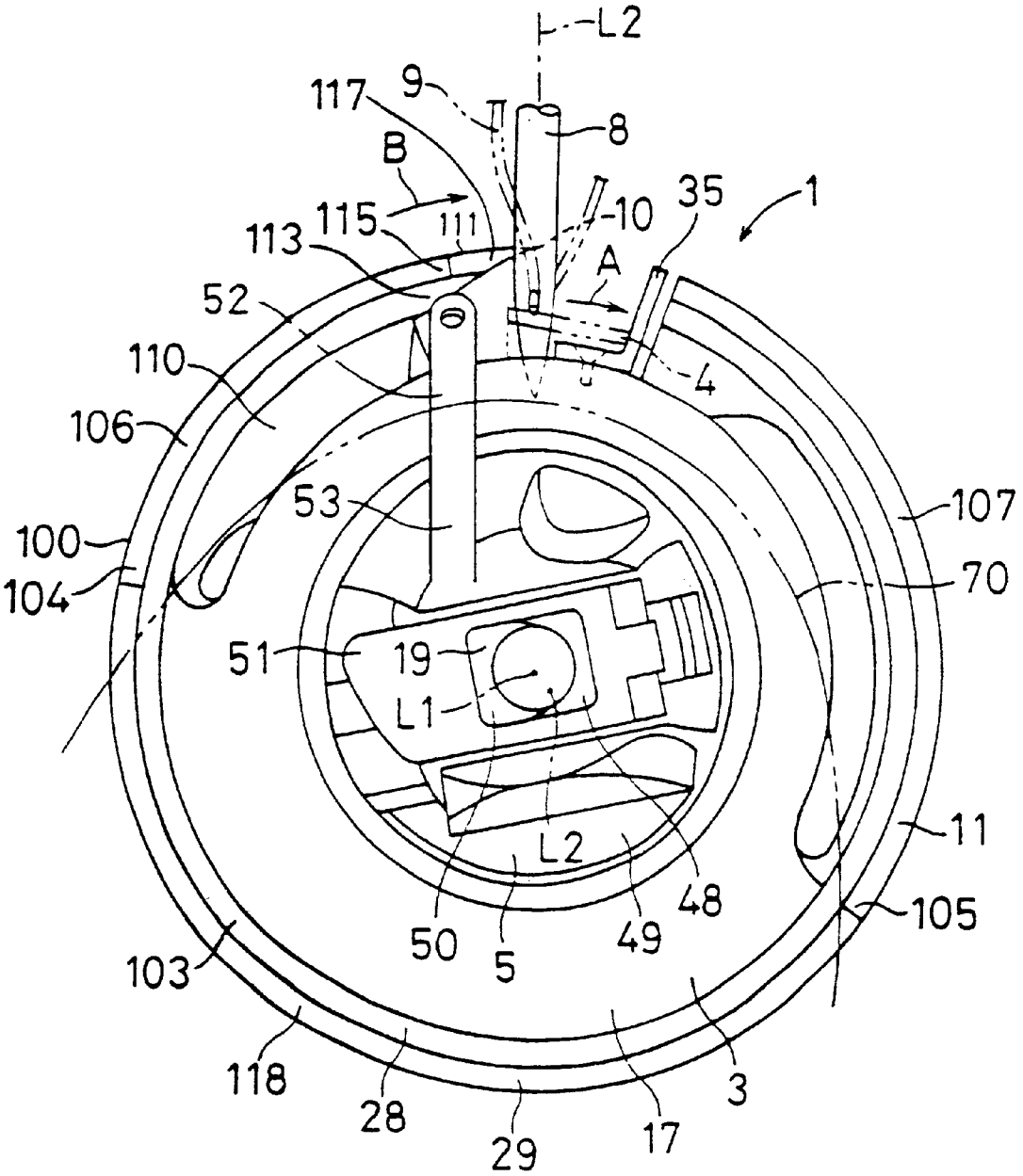
FIG. 2 is a front view of the full rotary hook 1.

FIG. 1 is a section view showing a full rotary hook 1 of an embodiment of the invention, and FIG. 2 is a front view showing the full rotary hook 1 as seeing from the left side of FIG. 1. The full rotary hook 1 has a shuttle race body 2, a shuttle body 3, a driver 4, a bobbin case 5, and a bobbin 6. The full rotary hook 1 is placed below a throat plate disposed on a sewing machine bed (not shown). The shuttle race body 2 is fixed to the body of a sewing machine, and a track groove 7 which elongates in the circumferential direction of the shuttle race body is formed in an inner peripheral portion thereof. The shuttle body 3 has a loop seizing beak 10 for seizing a needle thread 9 supplied by a needle 8 which is vertically reciprocated, and a track projection 11 which elongates in the circumferential direction of the shuttle body 3 is formed in an outer peripheral portion thereof. The track projection 11 is fitted into the track groove 7, and the shuttle body is rotatably attached to the shuttle race body 2. The driver 4 is continuously rotated in a predetermined rotation direction A in synchronization with the vertical motion of the needle 8, and presses the shuttle body 3 by means of the rotation, thereby rotating the shuttle body. The bobbin case 5 is detachably attached to the shuttle body 3. A bobbin thread 12 is wound around the bobbin 6, and the bobbin is then attached to the bobbin case 5, so that the bobbin thread 12 is accommodated in the bobbin case 5.

The shuttle race body 2 is fixed in a horizontally placed state so that its axis L1 is perpendicular to an axis L2 of a movement path of the needle 8 which is vertical. The track groove 7 elongates about the axis L1 in the circumferential direction, and is opened to the radial inner side. The shuttle race body 2 has the shuttle race main body 14, and a shuttle body presser 15 which is detachably fixed to the shuttle race main body 14. When the shuttle body presser 15 is detached from the shuttle race body 14, the track groove 7 is opened in one of the axial directions.

Figure 3:
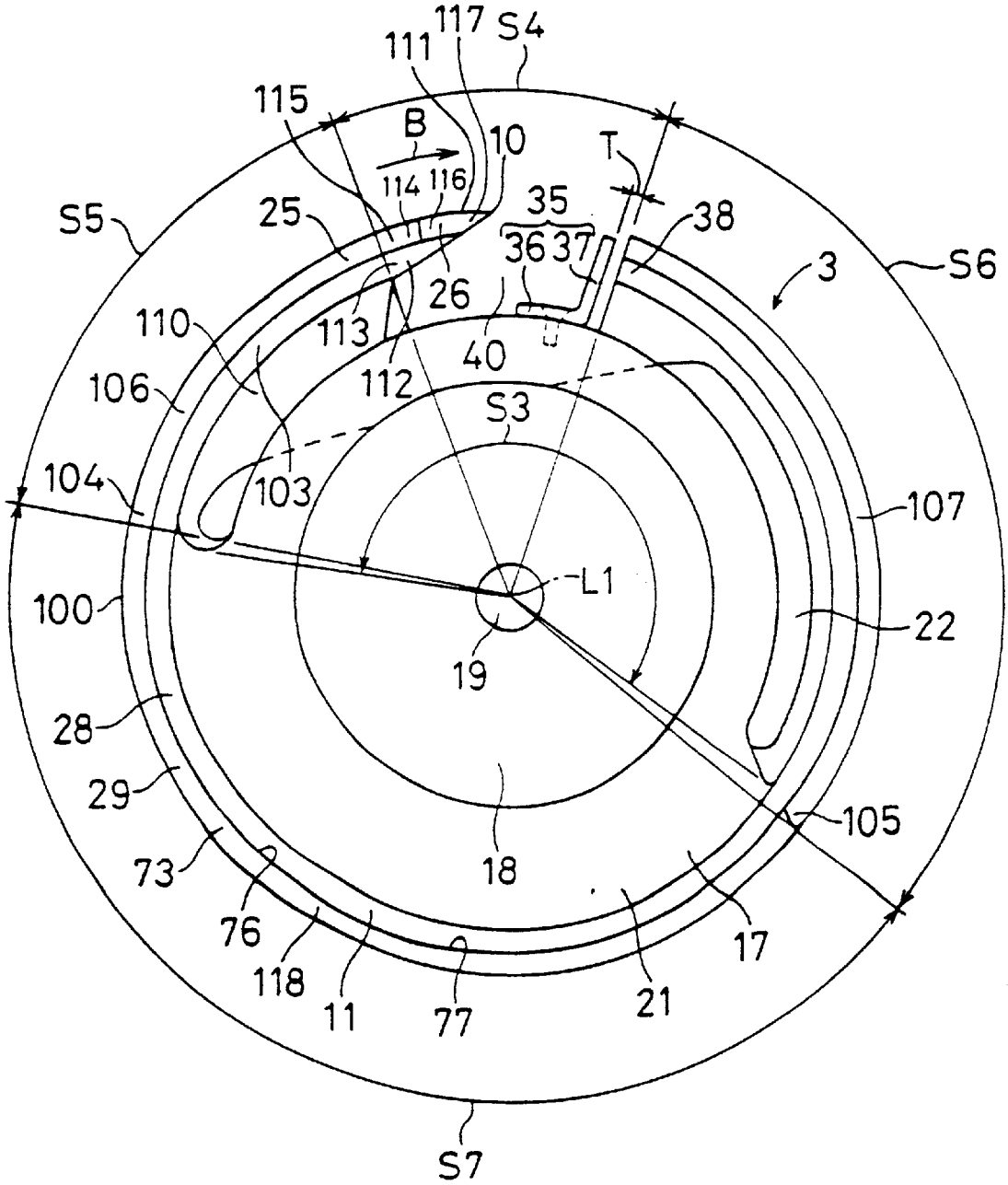
FIG. 3 is a front view of a shuttle body 3.
Figure 4:
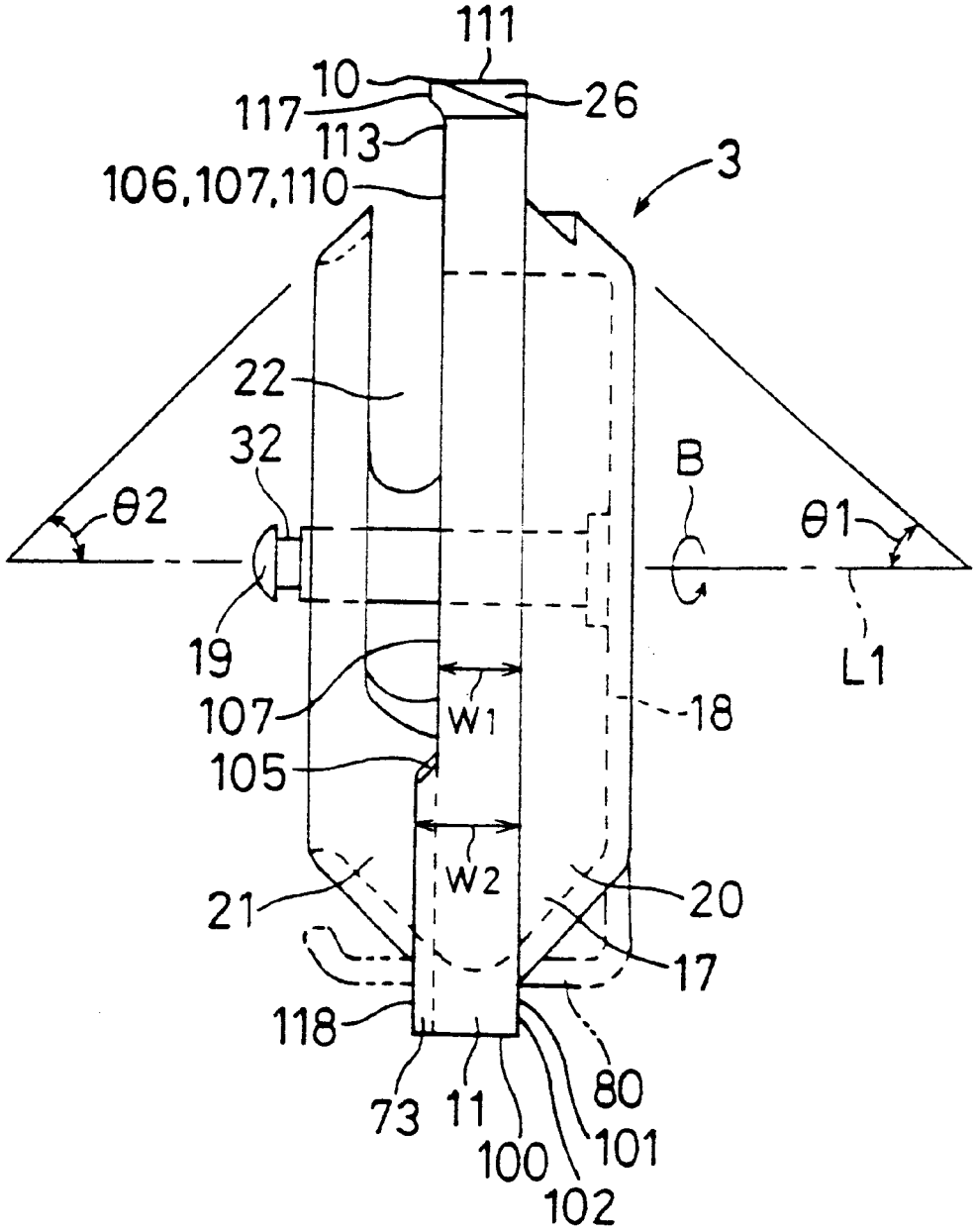
FIG. 4 is a side view of the shuttle body 3.
Figure 5:
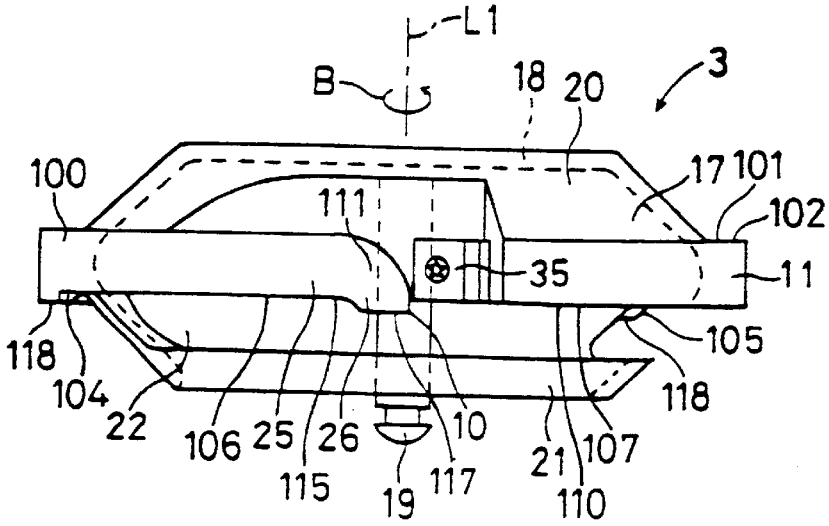
FIG. 5 is a plan view of the shuttle body 3.
Figure 6:
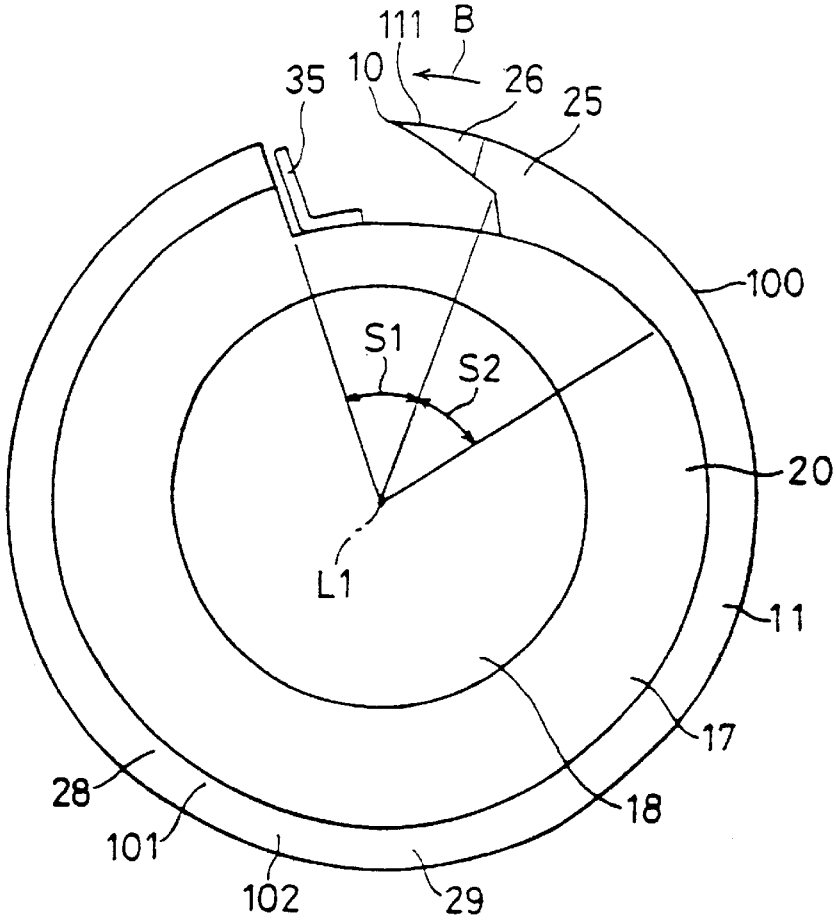
FIG. 6 is a rear view of the shuttle body 3.

FIG. 3 is a front view showing the shuttle body 3, FIG. 4 is a side view showing the shuttle body as seeing from the right side of FIG. 3, FIG. 5 is a plan view as seeing from the upper side of FIG. 3, and FIG. 6 is a rear view as seeing from the rear side of FIG. 3. Referring to FIGS. 1 and 2 also, the shuttle body 3 is attached to the shuttle race body 2 while its axis coincides with the axis L1 of the shuttle race body 2 (hereinafter, also the axis of the shuttle body 3 is denoted by the reference symbol L1). The track projection 11 elongates about the axis L1 in the circumferential direction, and protrudes toward the radial outer side. The shuttle body 3 has: a peripheral wall 17 in which the track projection 11 is formed in the outer peripheral portion; a bottom wall 18 which is continuous from one axial end portion of the peripheral wall 17, and integrally formed along a virtual plane that is perpendicular to the axis L1; and a stud 19 which perpendicularly protrudes along the axis L1 from the center of the bottom wall 18 toward the axial other end of the peripheral wall 17. The shuttle body is opened in the other end which is in the axial direction of the body with respect to the bottom wall 18.

The peripheral wall 17 elongates over the whole periphery in the circumferential direction, and has a peripheral wall portion 20 which is on the bottom wall 18 side with respect to the center in the axial direction, and a wall portion 21 which is on the open end side with respect to the center in the axial direction. The bottom wall-side peripheral wall portion 20 is formed continuously with the bottom wall 18. In regions S1 and S2 where the loop seizing beak 10 is formed with respect to the circumferential direction, the bottom wall-side peripheral wall portion 20 is formed into a cylindrical shape, and, in the remaining region other than the regions S1 and S2 with respect to the circumferential direction, formed into a truncated conical shape in which the diameter is larger as moving in the axial direction from the bottom wall 18 toward the open end.

In the region S1 of the bottom wall-side peripheral wall portion 20 which elongates in both the sides of the position where the loop seizing beak 10 is formed, the outer peripheral face near the bottom wall 18 is formed into the same shape as that of the truncated conical shape of the remaining region other than the regions S1 and S2. In the region S2 of the bottom wall-side peripheral wall portion 20 which is continuous to the region S1 of the bottom wall-side peripheral wall portion 20 in the upstream side in a counterclockwise direction as seeing the shuttle body 3 in the region S1 from the rear side, the outer peripheral face near the bottom wall 18 is formed into a truncated conical shape in the same manner as the region S1, and that near the shuttle body open end is formed so as to more approach the truncated conical outer peripheral face of the remaining region other than the regions S1 and S2 as further moving toward the upstream side in the direction of the arrow B. The regions S1 and S2 which are formed into a cylindrical shape extend in a range of about 60 deg. in the circumferential direction and centered at a position which is shifted toward the upstream side in the direction indicated by the arrow B from the position where the loop seizing beak 10 is formed with respect to the circumferential direction. In the bottom wall-side peripheral wall portion 20, at least the portion near the bottom wall 18 smoothly elongates over the whole periphery in the circumferential direction, and the outer peripheral face of the portion is formed into a truncated conical shape in which the diameter is smaller as moving from the open end toward the bottom wall 18.

The open-end peripheral wall portion 21 is continuous to the end of the bottom wall-side peripheral wall portion 20 which is opposite to the side that is continuous to the bottom wall 18, and formed into a truncated conical shape in which the diameter is smaller as moving in the axial direction from the bottom wall 18 toward the open end. In a region S3 which elongates in both the sides of the position where the loop seizing beak 10 is formed, with respect to the circumferential direction, a needle drop hole 22 which passes through in a radial direction is formed in a portion near the bottom wall-side peripheral wall portion 20. The region S3 where the needle drop hole 22 is formed is formed in a range of about 220 deg. in the circumferential direction and centered at a position which is shifted toward the downstream side in the direction of the arrow B or a clockwise direction as seeing the shuttle body 3 from the front side, from the position where the loop seizing beak 10 is formed with respect to the circumferential direction. In the open-end peripheral wall portion 21, at least the portion near the open end smoothly elongates over the whole periphery in the circumferential direction, and the outer peripheral face of the portion is formed into a truncated conical shape in which the diameter is smaller as moving from the bottom wall 18 toward the open end.

The peripheral wall 17 has the thus configured peripheral wall portions 20 and 21, and has a shape in which an axial center portion swells toward the radial outer side. The track projection 11 is formed in the axial center portion of the peripheral wall 17 so as to bulge toward the radial outer side. The track projection 11 is notched away to be divided in a region S4 near the position where the loop seizing beak 10 is formed with respect to the circumferential direction, and, in the remaining regions S5 to S7, elongates continuously in the circumferential direction. The region S4 where the track projection 11 is notched away is in a range of about 30 deg. in the circumferential direction and centered at the position where the loop seizing beak 10 is formed, with respect to the circumferential direction.

In the track projection 11, a section taken along a virtual plane including the axis L1 has a substantially rectangular shape. The track projection has an inner peripheral portion 28 and an outer peripheral portion 29. The outer peripheral portion 29 more protrudes toward the open end of the bobbin case holder than the inner peripheral portion 28. With respect to the width in the axial direction of the outer peripheral portion 29, the widths W1 of the regions S5 and S6 near the ends of the circumferential direction are smaller than the width W2 of the region S7 between the regions S5 and S6 in the circumferential direction. Therefore, the projection amounts of the regions S5 and S6 with respect to the inner peripheral portion 28 are smaller than the projection amount of the region S7. The region which is a total of the region S4 where the track projection is notched away, and the regions S5 and S6 where the outer peripheral portion 29 has a smaller width substantially coincides with the region S3 where the needle drop hole 22 is formed, with respect to the circumferential direction.

An outer peripheral face 100 of the outer peripheral portion 29 which serves as the outer peripheral face of the track projection 11 is formed as a cylindrical face, and bottom wall-side end faces 101, 102 of the portions 28 and 29 which serve as the end faces of the track projection 11 on the bottom wall 18 side are formed as flat faces perpendicular to the flush axis L1. An end face 103 of the inner peripheral portion 28 on the side of the bobbin case holder open end which constitutes the end face of the track projection 11 on the bobbin case holder open end side is formed as a flat face perpendicular to the axis L1. With respect to end faces of the outer peripheral portion 29 on the side of the bobbin case holder open end which constitute the end faces of the track projection lion the bobbin case holder open end side, the end faces 104, 105 are inclinedly formed in the ends of the regions S5 and S6 near the region S7, and the end faces 106, 107, and 118 are formed as flat faces perpendicular to the axis L1 in the remaining region other than the ends.

An end face 110 of a portion of the open-end peripheral wall portion 21 which faces the needle drop hole 22 from the bottom wall 18 side is formed in the same face as the end faces 106, 107 of the regions S5 and S6 of the outer peripheral portion 29 of the track projection 11 on the shuttle body open end side. In the region S4 where the track projection 11 is notched away, the portion of the open-end peripheral wall portion 21 on the bottom wall 18 side is formed into a cylindrical shape. In the region S4 where the track projection 11 is notched away, therefore, the outer peripheral faces of the peripheral wall portions 20 and 21 in an intermediate portion between the axial ends are formed as the identical cylindrical face about the axis L1.

A loop-seizing-beak-forming-portion 26 is integrally formed on the peripheral wall 17 so as to protrude from a circumferential one end 25 of the track projection 11 which is an end on the downstream side in the direction of the arrow B, and further in the direction of the arrow B. The loop seizing beak 10 is formed in the loop-seizing-beak-forming-portion 26. The loop-seizing-beak-forming-portion 26 functions also as a track projection. The loop-seizing-beak-forming-portion 26 is formed in the direction of the arrow B and the axial direction of the shuttle body 3 so as to be tapered along the direction from the bottom wall 18 toward the open end.

In the loop-seizing-beak-forming-portion 26, an outer peripheral face 111 is formed on the same cylindrical face as the outer peripheral face 100 of the track projection 11, an end face 113 of an inner peripheral face 112 on the side of the shuttle body open end is formed on the same flat face as the end face 103 of the inner peripheral portion 28 of the track projection 11 on the side of the shuttle body open end, an end face 115 of a basal end 114 of the outer peripheral portion on the side of the shuttle body open end is formed on the same flat face as the end faces 106 and 107 in the regions S5 and S6 of the outer peripheral portion 29 of the track projection 11 on the shuttle body open end side, an end face 117 of a tip end 116 on the shuttle body open end side is formed on the same flat face as the end face 118 in the region S7 of the outer peripheral portion 29 of the track projection 11 on the shuttle body open end side, and an end face on the bottom side is inclinedly formed so that an end face 119 on the basal end is formed on the same flat face as the end face on the bottom wall side of the track projection 11 and an end face 120 of the tip end further approaches the shuttle body open end from the bottom wall 18 as moving in the direction of the arrow B. The loop seizing beak 10 is formed at the tip end of in the loop-seizing-beak-forming-portion 26. The loop seizing beak 10 is positioned on a circle where a plane including the end face 118 on the shuttle body open end side in the region S7 of the outer peripheral portion 29 of the track projection 11 intersects with the cylindrical face including the outer peripheral face 100 of the track projection 11.

The shuttle body 3 has a spring member 35, which is disposed in a recess 40 formed between the circumferential ends 25 and 38 of the track projection 11. The spring member 35 has a substantially L-like shape. A portion 36 on the side of a basal end is placed along the circumferential direction, and fixed by screws or the like to an outer peripheral portion of the cylindrically-shaped peripheral wall 17 in the region S4 where the track projection is notched away. Under this state, a portion 37 on the free end side is outward projected in a radial direction. The portion 37 on the free end side is placed in the recess 40 of the peripheral wall including the circumferential other end 38 of the track projection 11, with forming a gap T1 with respect to the end which faces in the direction opposite to that of the arrow B and is on the upstream side in the direction of the arrow B. According to this configuration, the spring member 35 can be elastically deformed in the direction of the arrow B. The spring member 35 is placed so as not to project outwardly in the axial direction and a radial direction from a movement path of the track projection when the shuttle body 3 is rotated about the axis L1.

The bottom wall 18 is on a disk, and continuous integrally with the bottom-wall-side peripheral wall portion 20 of the peripheral wall 17 over the whole periphery in the circumferential direction. A stud 19 is continuous integrally with the bottom wall 18, and perpendicularly protrudes from the bottom wall 18. The stud 19 has a substantially columnar shape. An engaging groove 32 which elongates in the circumferential direction is formed in the tip end portion. In the thus configured shuttle body 3, the peripheral wall 17, the bottom wall 18, and the stud 19 are integrally formed, and the spring member 35 is made of spring steel or the like.

Figure 7:
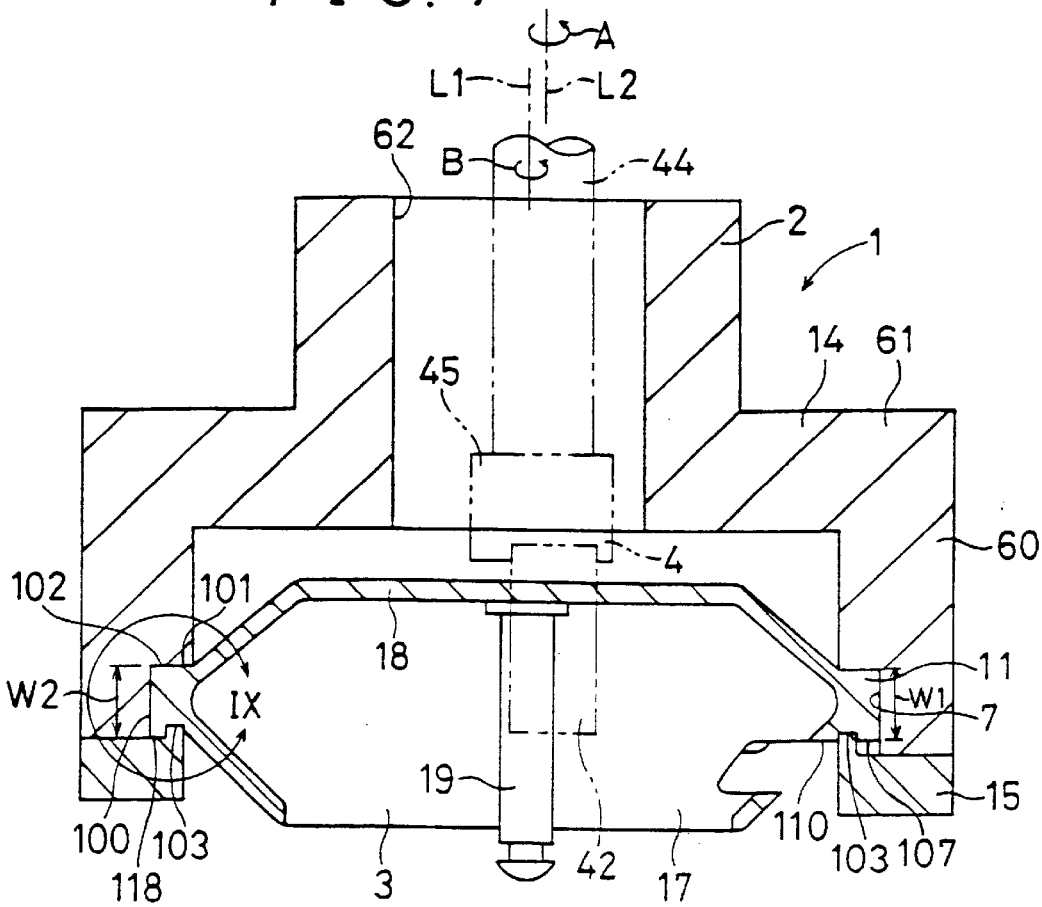
FIG. 7 is a horizontal section view showing a shuttle race body 2 and the shuttle body 3 in a simplified manner.

FIG. 7 is a horizontal section view showing the shuttle race body 2 and the shuttle body 3 in a simplified manner. The shuttle race main body 14 of the shuttle race body 2 has a peripheral wall 60, and a bottom 61 which is continuous to one axial end of the peripheral wall 60. A penetration hole 62 which is passed through in the axial direction is formed in the bottom 61. The shuttle body presser 15 has an annular shape, and is detachably attached to the peripheral wall 60 of the shuttle race main body 15 by screws or the like. The shuttle race body 2 is opened on the side opposite to the bottom 61.

The shuttle body presser 15 is detached from the shuttle race main body 14 to open the shuttle race body open end side of the track groove 7 in the axial direction. Under this state, the track projection 11 is fitted into the track groove 7, and the shuttle body presser 15 is attached to the shuttle race main body 14 to attain a locked state. The shuttle body 3 is then attached to the shuttle race body 2. The shuttle body 3 is attached while the bottom wall 18 is placed near the bottom 61 of the shuttle race main body 14. Under the state where the shuttle body 3 is attached to the shuttle race body 2, the shuttle body is guided by the portion where the track projection 11 faces the track groove 7, and the shuttle body is rotatable about the axis L1.

Referring to FIGS. 1, 2, and 7, the driver 4 has: the driver body 43 comprising a pressing portion 42 which presses the shuttle body 3; and a cylindrical boss 45 which is positioned in the circumferential direction and fixed to a lower shaft 44 of the sewing machine, and is disposed in the shuttle race body 2. The boss 45 is placed behind the shuttle body 3, and fixed to the lower shaft 44 which is passed through the penetration hole 62 of the shuttle race main body 14 and elongates to the vicinity of the shuttle body 3. The driver body 43 is formed into a substantially L-like shape, and has: a basal portion 46 which is outwardly elongated from an end of the boss 45 near the shuttle body 3 in a radial direction, and along the bottom wall 18 of the shuttle body 3; and the pressing portion 42 which is bent from a radial outer end of the basal portion 46 toward the open end of the shuttle body 3, and which elongates toward the open end of the shuttle body 3 in the axial direction. The tip end portion of the pressing portion 42 is fitted into the recess 40 of the shuttle body 3. Spaces respectively having gaps T2 and T3 which are larger than the thickness (outer diameter) of the needle thread 9 are formed between the pressing portion 42 of the driver body 43 and the cylindrically formed peripheral wall 17 of the shuttle body 3, between the basal portion 43 and the bottom wall 18 of the shuttle body 3, and between the boss 45 and the bottom wall 18 of the shuttle body 3. When the lower shaft 45 of the sewing machine is continuously rotated about the axis L3 in the direction of the arrow A or a clockwise direction as seeing from the front side, the thus configured driver 4 is continuously rotated about the same axis L3 in the same direction or the direction of the arrow A. When the driver 4 is rotated, the tip end of the pressing portion 42 of the driver body 43 presses the spring member 35 of the shuttle body 3 in the direction of the arrow A, whereby the shuttle body 3 is rotated in the direction of the arrow B which is substantially identical with the rotation direction A of the driver 4.

The bobbin case 5 has a peripheral wall 47 on which a bobbin thread tension spring that is not shown is disposed, and an end wall 49 which is perpendicularly continuous from one axial end of the peripheral wall 47, and in which a latch mechanism 48 is disposed, and is opened on the side opposite to the end wall 49. The latch mechanism 48 has a latch 50 which is displaceable in one diameter line direction, is urged by a spring force toward one side along the one diameter line, and can be displaced against the spring force by an operating piece 51. A part of the latch 50 is fitted into the engaging groove 32 of the stud 19 so that the latch 50 is engaged to the stud 19. The bobbin case 5 is attached to the shuttle body 3 so as to be rotatable about the axis L1 with respect to the shuttle body 3, while the axis of the bobbin case is set to coincide with the axis L1 of the shuttle body 3, and the end wall 49 is placed on the shuttle body open end side.

In the bobbin case 5, a horn portion 53 is integrally formed which elongates from the end wall 49 along a plane including the end wall 49, and in which a tip end portion 52 is bent toward the open end of the bobbin case 5 outside the peripheral wall 17 of the shuttle body 3. Under a state where the bobbin case 5 is attached to the shuttle body 3, the horn portion 53 is fitted into a locking recess (not shown) which is formed in the shuttle body presser 15 of the shuttle race body 2, thereby blocking the rotation about the axis L1 due to the rotation of the shuttle body 3. The positioning is performed under a state where the horn portion 53 upwardly elongates.

The bobbin 6 is attached to the bobbin case 5 so as to accommodate the bobbin thread 12 wound around the bobbin 6, which bobbin case 5 is attached to the shuttle body 3 in a state where the bobbin 6 is attached to the bobbin case 5 and the bobbin thread 12 is accommodated therein. The bobbin thread 12 accommodated in the bobbin case 5 is pulled out from the bobbin 6, passed between the peripheral wall 47 of the bobbin case and the bobbin thread tension spring, passed over the axial other end of the shuttle body, passed through a through hole 55 formed in a tip end portion 52 of the horn portion 53, and then guided to the upper side through a needle hole formed in the throat plate.

When the sewing operation is started, the driver 4 is rotated about the axis L3 in the direction of the arrow A by the rotation of the lower shaft 44, and the shuttle body 3 is rotated about the axis L1 in the direction of the arrow B. By the rotation of an upper shaft which is not shown and interlocked with the lower shaft 44, the needle 8 is vertically reciprocated along the axis L2 in synchronization with the rotation of the shuttle body 3. A through hole 66 is formed in the needle 8, and the needle thread 9 is passed through the hole. When the needle 8 is placed in the vicinity of the lowest position as a result of the vertical reciprocation of the needle 8, therefore, the needle thread 9 is supplied into the movement path of the loop seizing beak 10. The shuttle body 3 and the needle 8 are positioned so that, when the needle 8 is passed over the lowest position and then displaced slightly upwardly, the loop seizing beak 10 is passed through the vicinity of the movement path of the needle 8. The needle thread 9 supplied by the movement path of the needle 8 is seized by the loop seizing beak 10.

The needle thread 9 seized by the loop seizing beak 10 is pulled in the rotation direction B of the shuttle body 3 by the loop-seizing-beak-forming-portion 26, to form a loop of the needle thread. The loop of the needle thread 9 is moved over the periphery of the shuttle body 3 while being guided by the peripheral wall 17 of the shuttle body 3 to be extended, so that the two thread portions of the loop of the needle thread which vertically elongate are passed over the bottom wall side of the shuttle body 3, and the open end side of the shuttle body, respectively. In this way, until the loop seizing beak 10 reaches the vicinity of the lowest point, the needle thread 9 is passed through the right side with respect to a virtual vertical plane including the axes L1 and L2 as seeing from the front side, and downwardly pulled by the loop-seizing-beak-forming-portion 26 while sliding over the outer surface of the shuttle body 3. When the loop seizing beak 10 reaches the vicinity of the lowest point, the needle thread 9 is pulled up by a thread take-up lever which is not shown, with passing through the left side with respect to the virtual vertical plane including the axes L1 and L2 as seeing from the front side. In this way, the loop of the needle thread 9 is passed over the shuttle body 3, so that the loop is passed over the bobbin case 5 attached to the inside of the shuttle body 3. As a result, the needle thread 9 is wound around the bobbin thread 12 pulled out from the bobbin case 5, and a stitch is then formed. When the shuttle body 3 is further rotated and the loop seizing beak 10 reaches the vicinity of the movement path of the needle 8, the needle thread 9 is again supplied by the needle 8, and the above-described operation is repeated to continuously form stitches, whereby a workpiece on the throat plate can be sewn.

In the full rotary hook 1 according to the invention, since the shuttle body 3, which seizes the needle thread 9 and moves the loop of the needle thread 9 while expanding it, is rotated by the driver 4 which is separately formed, the needle thread 9 can be passed over the shuttle body 3 when the thread is passed over the bobbin case 5. Therefore, the loop of the needle thread 9 can be passed over the bobbin case 5 under a state where the loop is expanded into a substantially U-like shape without crossing in an intermediate portion, and the needle thread 9 is wound around the bobbin thread 12 without forming a twist. The driver 4 is continuously rotated in the predetermined rotation direction A, and, in accordance with the rotation, the shuttle body 3 is continuously rotated. The driver 4 and the shuttle body 3 do not stop during an operation of one cycle, and hence the full rotary hook 1 can be operated at a high speed to increase the sewing speed.

In the full rotary hook 1, the needle drop hole 22 is formed in the open-end peripheral wall portion 21 of the peripheral wall 17, and, when the needle 8 is downwardly displaced in order to place the needle thread 9 in the vicinity of the movement path of the loop seizing beak 10, it is possible to prevent the needle 8 from interfering with the peripheral wall 17 of the shuttle body 3. This will be described in detail as follows. In the embodiment, the shuttle body 3 and the needle 8 are disposed so as to be in synchronism with each other so that, when the needle 8 is passed over the lowest position and then displaced slightly upwardly, the loop seizing beak 10 is passed through the vicinity of the movement path of the needle 8. With respect to the shuttle body 3, the tip end of the needle 8 is passed through a movement path 70 which is indicated by the phantom line in FIG. 2. Therefore, the needle drop hole 22 is formed in the region S3 configured as described above so that the movement path 70 does not intersect with the peripheral wall portion 21, thereby preventing interference between the shuttle body 3 and the needle 8 from occurring.

Since the needle 8 is vertically moved in the vicinity of the track projection 11, the track projection 11 is notched away or the width W of the outer peripheral portion 29 of the track projection 11 is selected so as to be small, in the regions S4 to S6 which substantially coincide with the region S3 where the needle drop hole 22 is formed. Interference between the shuttle body 3 and the needle 8 is prevented also by this configuration from occurring. More specifically, in the region S4, the track projection 11 is notched away, and hence interference with the needle 8 does not naturally occur. In the regions S5 and S6, their widths W1 are selected so as to be smaller than the width W2 of the region S7 and the amount of projection toward the shuttle body open end is small, and, in other words, the end faces 106 and 107 in the regions S5 and S6 are more retracted toward the bottom wall 18 of the shuttle body than the end face 118 in the region S7, thereby preventing interference between the needle 8 and the track projection 11 from occurring. As described above, in both the sides of the loop seizing beak 10 with respect to the circumferential direction, the track projection 11 is notched away or retractively formed so as to avoid interference with the needle 8. In addition, in the tip end portion 116 of the outer peripheral portion of the loop-seizing-beak-forming-portion 26, the end face 117 on the shuttle body open end side more protrudes toward the shuttle body open end side than the end faces 106 and 107 in the regions S5 and S6 on the shuttle body open end side, in the same manner as the end face 118 on the shuttle body open end side in the region S7 of the outer peripheral portion 29 of the track projection 11. The needle thread 9 supplied by the needle 8 is seized by the loop seizing beak 10 which is formed in the plane including the protruding end faces 117 and 118. Since the loop-seizing-beak-forming-portion 26 is passed through a recess 120 formed in the needle 8, the portion does not interfere with the needle 8.

In the embodiment, the axial center portion of the peripheral wall 17 of the shuttle body 3 more swells toward the radial outer side than the remaining portion, and the peripheral wall has the peripheral wall portions 20 and 21 formed into a truncated conical shape in which the diameter is smaller as moving from the axial center portion toward the axial ends, and the outer peripheral face of a truncated conical shape in which the diameter is smaller as moving toward the axial ends. Furthermore, the loop-seizing-beak-foriming-portion 26 where the loop seizing beak 10 for seizing the needle thread 9 is formed is formed in the axial center portion which swells toward the outer side in a radial direction, and, with respect to the loop of the needle thread 9 seized by the loop seizing beak 10, the two needle thread portions which vertically elongate are smoothly guided and expanded by the outer peripheral face of the peripheral wall 17 toward the bottom wall 18 side and the shuttle body open end side, respectively. Therefore, the loop of the needle thread 9 can be smoothly passed over the shuttle body 3. In each of the peripheral wall portions 20 and 21, at least the portions which are positioned at the axial ends of the peripheral wall 17 continuously elongate over the whole periphery in the circumferential direction, and their outer peripheral faces are formed into a truncated conical shape such as that described above. Therefore, the loop of the needle thread 9 is prevented from being caught by the shuttle body 3 when the loop is passed over the hook. The angles θ1 and θ2 formed by the axis L1 and the outer peripheral faces of the peripheral wall portions 20 and 21 which are formed into a truncated conical shape have the same value of, for example, about 45 to 48 deg. Each of the needle thread portions of the loop of the needle thread 9 which is guided by the peripheral wall portions 20 and 21, is enabled to perform the thread passing while being passed over at substantially the same timing the position on the bottom side, and that on the shuttle body open end side which correspond to each other in the axial direction of the shuttle body, respectively.

Figure 8:
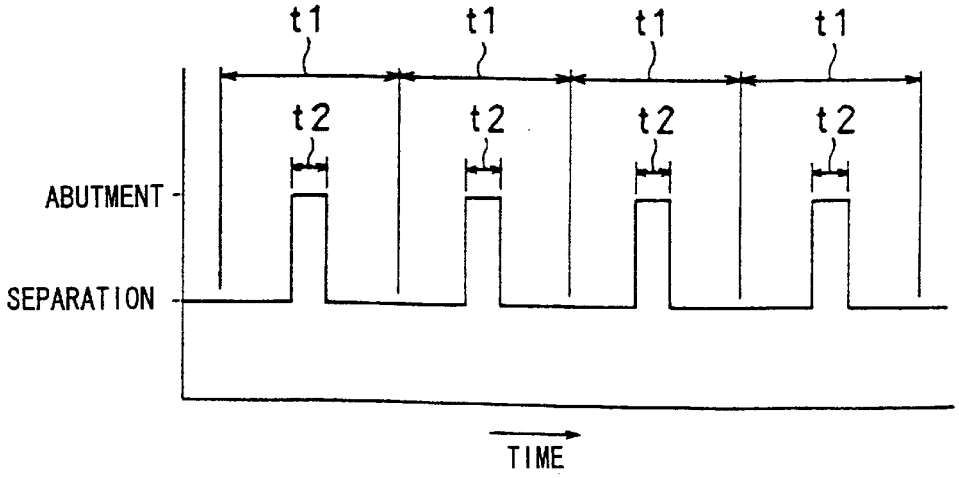
FIG. 8 is a graph showing abutment and separation relationships between a driver 4 and a spring member 35.

In the full rotary hook 1, the shuttle body 3 is rotated while the driver 4 presses the portion 37 on the free end side of the spring member 35 of the shuttle body 3. When the driver 4 is continuously rotated and the shuttle body 3 is rotated, therefore, the spring member 35 periodically repeats an elastic deforming operation and a recovering operation from the elastic deformation. Consequently, the driver 4 and the portion 37 on the free end side of the spring member 35 periodically abut against and separate from each other, or, as shown in FIG. 8, have a time period when they separate from each other, and a time period t2 when they abut against each other in one cycle t1 of the operation of the full rotary hook 1. When the loop of the needle thread 9 is to be passed over the shuttle body 3, the loop can be passed through the gap between the driver 4 and the portion 37 on the free end side of the spring member 35 at the timing when the driver 4 separates from the portion 37 on the free end side of the spring member 35. When the loop of the needle thread 9 is to be passed over the shuttle body 3, therefore, the needle thread 9 can be prevented from being pressed between the shuttle body 3 and the driver 4 to be caught thereby, and the loop of the needle thread 9 can smoothly perform the thread passing. Even when the needle thread 9 is accidentally pressed between the shuttle body 3 and the driver 4, the needle thread 9 elastically deforms the spring member 35 and can be then passed between the driver 4 and the spring member 35. Therefore, a breakage of the needle thread 9 does not occur.

By selecting spring constant of the spring member 35, it is possible to select the time period t2 when the tip end portion of the pressing portion 42 of the driver 4 abuts against the portion 37 on the free end side of the spring member 35.

In the full rotary hook 1, the rotation axis L3 of the driver 4 is eccentric with respect to the rotation axis L1 of the shuttle body 3. In the embodiment, the rotation axis L3 is eccentric with respect to the rotation axis L1 so as to be slightly shifted to the lower right as seeing from the front side. When the axes L1 and L3 are eccentric with each other as described above, the position where the driver 4 presses the shuttle body 3 is changed in a radial direction of the shuttle body 3, so that the torque transmitted from the driver 4 to the shuttle body 3 is periodically changed. As a result, at a time when the torque is low, the loop of the needle thread is allowed to pass between the driver and the shuttle body.

By selecting direction and amount of eccentricity of the axes L1 and L3, it is possible to select the timing when the pressing portion 42 of the driver 4 separates from the portion 37 on the free end side of the spring member 35 during one cycle of the operation of the full rotary hook 1. Therefore, the pressing portion 42 of the driver 4 can surely separate from the portion 37 on the free end side of the spring member 35 when the needle thread 9 is pulled up by the thread take-up lever and the needle thread is passed between the driver 4 and the spring member 35.

In the full rotary hook 1, the shuttle body 3 has the peripheral wall on which the track projection is formed, and the loop of the needle thread seized by the loop seizing beak is moved along the periphery of the shuttle body while being guided and expanded by the peripheral wall, so that the loop of the needle thread can be easily passed over the shuttle body and the bobbin case. The needle drop hole into which the needle is to be inserted is formed in the peripheral wall, thereby preventing the needle and the shuttle body from interfering with each other.

Figure 9:
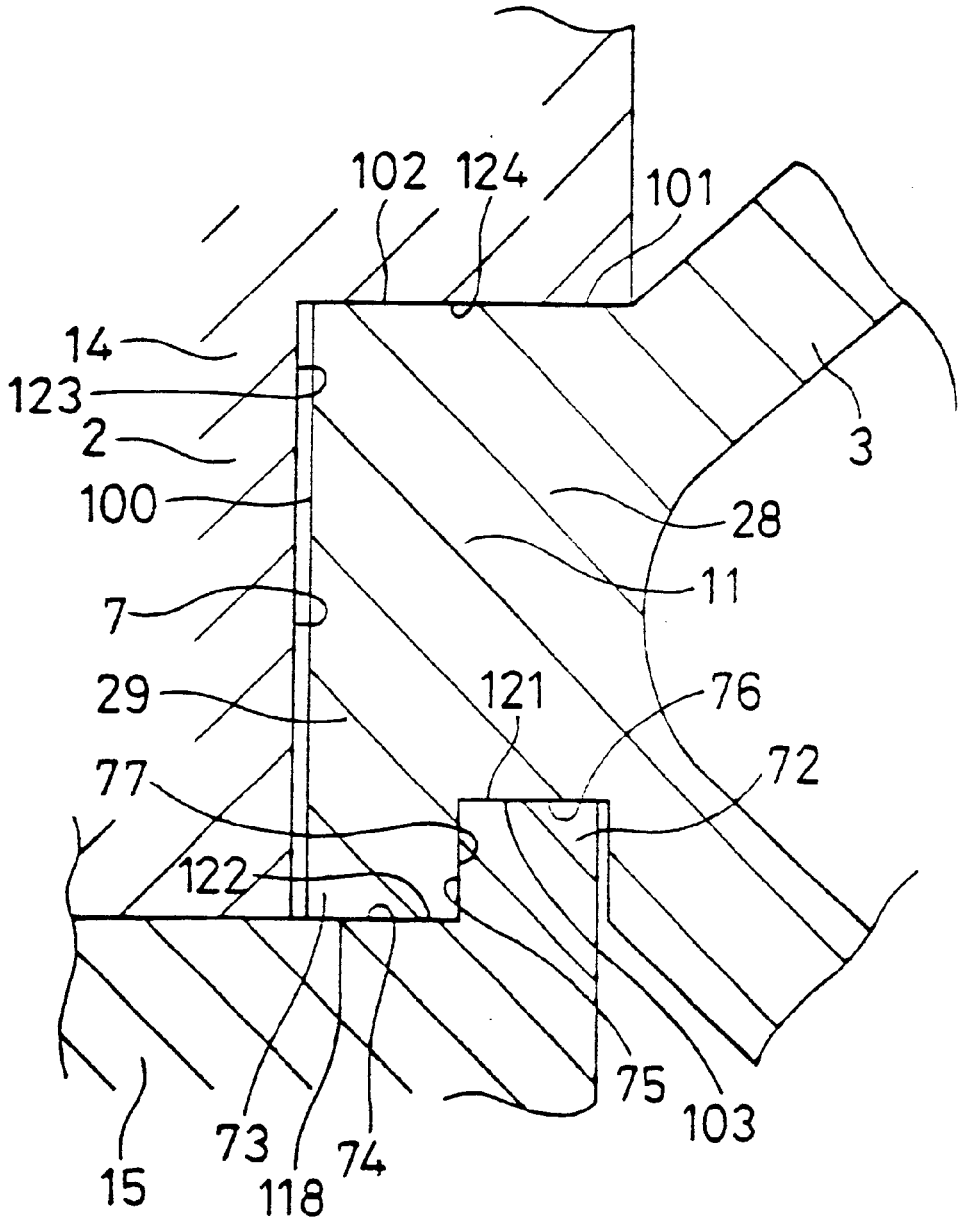
FIG. 9 is a section view enlargedly showing a section IX of FIG. 7.

FIG. 9 is an enlarged section view showing a section IX of FIG. 7. As described above, the full rotary hook 1 is configured so that the shuttle body 3 is rotated by the driver 4 which is separately formed, and the shuttle body 3 is not fixed to the lower shaft or the like of the sewing machine, and therefore the shuttle body is easily displaced in the shuttle race body 2 in a radial direction perpendicular to the axis L1. When the shuttle body 3 is rotated by the driver 4, therefore, the shuttle body vibrates in a radial direction. Furthermore, the cutaway portion for needle drop is formed in the track projection 11, and hence vibration is easily generated. In order to prevent such vibration from being generated, protrusions 72 and 73 are formed in the shuttle race body 2 and shuttle body 3 of the full rotary hook 1, respectively.

In the shuttle race body 2, the protrusion 72 is formed on the shuttle body presser 15. The protrusion 72 protrudes in the radial inner side of the track groove 7 and toward the bottom 61 of the shuttle race main body 14 in the axial direction. The protrusion 72 elongates in the circumferential direction, and hence the track groove 7 has a recess 74 which elongates in the radial outer side of the protrusion 72 and in the circumferential direction. In this way, with respect to end faces of the shuttle body presser 15 which face the track groove 7 and serve as end faces that face the track groove 7 of the shuttle race body 2 from the shuttle race body open end side, an end face 121 on the radial inner side more protrudes toward the bottom 61 of the shuttle race body 2 than an end face 122 on the radial outer side, and is formed as a flat face perpendicular to the axis L1. An outer peripheral face 75 of the protrusion 72 on the radial outer side is formed as a cylindrical face about the axis L1. An inner peripheral face 123 of the shuttle race main body 14 which faces the track groove 7 from the radial outer side is formed as a cylindrical face, and an end face 124 which faces the track groove 7 from the bottom 61 of the shuttle race body 2 is formed as a flat face perpendicular to the axis L1.

As described above, the track projection 11 of the shuttle body 3 has the inner peripheral portion 28 and the outer peripheral portion 29. The outer peripheral portion 29 more protrudes toward the open end of the shuttle body than the inner peripheral portion 28. In the track projection 11 of the shuttle body 3, therefore, the protrusion 73 is formed on the radial outer side. The protrusion 73 protrudes toward the open end of the shuttle body in the axial direction of the shuttle body 3. The protrusion 73 elongates in the circumferential direction. In the track projection 11, therefore, a recess 76 which elongates in the radial inner side of the protrusion 73 and in the circumferential direction is formed. An inner peripheral face 77 of the protrusion 73 on the radial inner side is formed as a cylindrical face about the axis L1.

The track projection 11 is fitted into the track groove 7 in a state where the protrusion 73 is fitted into the recess 74 and the protrusion 72 is fitted into the recess 76. The shuttle body 3 is attached to the shuttle race body 2 while the track projection 11 is fitted into the track groove 7 in this way. As described above, in order to avoid interference with the needle 8, the projection 11 in which the projection amounts of the regions S5 and S6 toward the shuttle body open end side and in the vicinity of the circumferential ends of the outer peripheral portion 29 of the track projection 11 are made smaller is guided by the portion facing the track groove 7, and rotated about the axis L1. When the shuttle body 3 is rotated by the driver 4 in this way, the inner peripheral face 77 of the protrusion 73 of the shuttle body 3 is supported by the outer peripheral face of he protrusion 72 of the shuttle race body 2, and the protrusion 73 of the shuttle body 3 is engaged to the protrusion 72 of the shuttle race body 2 from the radial outer side of the shuttle body 3. The outer diameter of the outer peripheral face 75 of the protrusion 72 is selected so as to be slightly smaller than the inner diameter of the inner peripheral face 77 of the protrusion 73. Under a state where the shuttle body 3 is attached to the shuttle race body 2, the gap between the faces 75 and 77 is as small as about two to three hundredths mm. Therefore, the shuttle body 3 is smoothly guided in the circumferential direction under a state where displacement in a radial direction is blocked. Consequently, the shuttle body 3 is stably rotated about the axis L1 while vibration in a radial direction during rotation is prevented from being generated, whereby hook noises are prevented from being generated at a high level. In the cycles of the full rotary hook 1, furthermore, the needle thread 9 behaves constantly, so that uniform stitches can be formed.

The full rotary hook 1 can be realized by slightly modifying an oscillating loop taker which has been already existing and described in the paragraph of Background Art, and a sewing machine comprising it. In the full rotary hook 1, it is requested only that the protrusion 72 is formed on a shuttle body presser of an existing shuttle race body, an existing shuttle body and an existing driver are replaced with the shuttle body 3 and the driver 4 described above, and a mechanism for converting a rotation to a half rotation is removed away from a driving system for driving a lower shaft of an existing sewing machine. A sewing machine is not necessary to be largely remodeled.

The embodiments described above are only examples of modes for carrying out the invention, and can be modified to other configurations within the scope of the invention. For example, the axis L2 of the movement path of the needle 8 may not be perpendicular to the rotation axis L1 of the shuttle body 3. As the spring member 35, another spring such as a compression coil spring, a tension coil spring, or a belleville spring may be used in place of the above-mentioned plate spring. Spring means which is configured not by a single spring but by a combination of a spring and another component such as a member for holding the spring may be used. Also these alternatives can attain the same effects. The protrusions 72 and 73 which are formed in the shuttle race body 2 and the shuttle body 3 may be formed on the bottom wall 18 side of the shuttle body 3 which is on the bottom side of the shuttle race body 2, or on both the sides in the axial direction, with attaining the same effects. The rotation axis L1 of the shuttle body 3 and the rotation axis L3 of the driver 4 may be coaxially placed. The peripheral wall 17 may be asymmetrically formed with respect to the track projection 11 positioned in an axial center portion, by, for example, selecting the inclination angles θ1 and θ2 of the peripheral wall portions 20 and 21 of the shuttle body 3 with respect the axis L1 to have different values, so that the passing timings of the thread portions of the loop of the needle thread 9 which vertically elongate may be different from each other on the sides of the bottom wall 18 and the open end of the shuttle body 3. As shown by the phantom line 80 in FIG. 4, the peripheral wall 17 of the shuttle body 3 may be formed into a substantially cylindrical shape to round the axial end portions, whereby the outer diameter of the attachable bobbin case 5 is made larger without increasing the whole outer diameter dimension of the shuttle body 3, thereby enhancing the accommodation capacity of the bobbin thread 12. Even when the peripheral wall 17 is formed into a substantially cylindrical shape as described above, the needle thread 9 can be smoothly guided toward the bottom wall 18 and the shuttle body open end so as to achieve smooth thread passing, because the axial end portions are rounded. In this way, the details of the full rotary hook 1 may be adequately modified.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

Industrial Applicability

According to the invention set forth in claim 1, the shuttle body which seizes the needle thread and moves the loop of the needle thread while expanding the loop is rotated by the driver which is separately formed. When the loop of the needle thread is to be passed over the bobbin case, therefore, the loop can be passed over the shuttle body. Consequently, the loop of the needle thread can perform the thread passing under a state where the loop is expanded into a substantially U-like shape without crossing in an intermediate portion, and the needle thread is wound around the bobbin thread without forming a twist. The driver is continuously rotated in a predetermined rotation direction, and, in accordance with the rotation, the shuttle body is continuously rotated. The driver and the shuttle body do not stop during an operation of one cycle, and hence the full rotary hook can be operated at a high speed.

The track projection has the inner peripheral portion and the outer peripheral portion, and the outer peripheral portion protrudes toward the shuttle body open end with respect to the inner peripheral portion to form the protrusion. In the outer peripheral portion of the track projection, the projection amount with respect to the inner peripheral portion in the regions near the circumferential ends is smaller than the projection amount with respect to the inner peripheral portion in the region of the circumferential intermediate portion which is between the regions near the circumferential ends. The loop-seizing-beak-forming-portion is formed so as to protrude in the rotation direction of the shuttle body from the one circumferential end of the track projection which is placed on the downstream side in the rotation direction of the shuttle body. The loop-seizing-beak-forming-portion functions also as the track projection which is fitted into the track groove. The loop-seizing-beak formed at the tip end of the loop-seizing-beak-forming-portion is formed in the plane including the end face on the shuttle body open end side in the region of the circumferential intermediate portion of the outer peripheral portion of the track projection.

As described above, the regions near the circumferential ends of the outer peripheral portion of the track projection are formed so as to have a small width and a small projection amount toward the shuttle body open end. According to this configuration, the needle which vertically moves in the vicinity of the track projection is prevented from interfering with the shuttle body. Although the loop seizing beak is formed in the plane including the end face on the shuttle body open end side in the region of the circumferential intermediate portion of the outer peripheral portion of the track projection, and the loop-seizing-beak-forming-portion protrudes toward the shuttle body open end, the loop-seizing-beak-forming-portion is passed through the recess formed in the needle, and hence does not interfere with the needle.

In the shuttle race body, the protrusion is formed to protrude toward the track groove, and the recess is formed on the radial outer side of the protrusion. In the track projection of the shuttle body, the protrusion is formed by the outer peripheral portion, and the recess is formed on the radial inner side of the protrusion. The protrusion of the shuttle race body is fitted into the recess of the track projection of the shuttle body, and the protrusion of the track projection of the shuttle body is fitted into the recess of the shuttle race body, and engaged with the protrusion of the shuttle race body from the radial outer side. Under this state, the track projection of the shuttle body is fitted into the track groove of the shuttle race body. The track projection of the shuttle body, in which the projection amount in the regions near the circumferential ends of the outer peripheral portion of the track projection is formed so as to be small in order to avoid interference with the needle, is guided by the portion facing the track groove of the shuttle race body, and the shuttle body is rotatable about its axis. Furthermore, the shuttle body is prevented from vibrating in a radial direction during rotation, and can be stably rotated.

According to the invention set forth in claim 2, when the driver is continuously rotated, the spring member periodically repeats an elastic deforming operation and a recovering operation from the elasticde formation. This causes the driver and the free end of the spring member or the vicinity of the free end to periodically abut against and separate from each other. When the loop of the needle thread is to be passed over the shuttle body, the loop can be passed through the gap between the driver and the free end of the spring member or the vicinity of the free end during a period when the driver and the free end of the spring member or the vicinity of the free end are separated from each other. When the loop of the needle thread is to perform the thread passing, therefore, the needle thread can be prevented from being pressed between the shuttle body and the driver to be caught thereby, and the loop of the needle thread can smoothly perform the thread passing. Even when the needle thread is accidentally pressed between the shuttle body and the driver, the needle thread elastically deforms the spring member and can be then passed between the driver and the spring member. Therefore, a breakage of the needle thread does not occur.

According to the invention set forth in claim 3, the position where the driver presses the shuttle body is changed in the radial direction of the shuttle body, so that the torque transmitted from the driver to the shuttle body is periodically changed. As a result, the rotation speed of the shuttle body can be periodically changed, and the passing timing of the loop seizing beak in the circumferential direction can be changed.

According to the invention set forth in claim 4, the shuttle body has the peripheral wall on which the track projection is formed, and the loop of the needle thread seized by the loop seizing beak is moved along the periphery of the shuttle body while being guided and expanded by the peripheral wall, so that the loop of the needle thread can be easily passed over the shuttle body and the bobbin case. The needle drop hole into which the needle is to be inserted is formed in the peripheral wall, thereby preventing the needle and the shuttle body from interfering with each other.

What is claimed is:

1. A full rotary hook comprising:

a shuttle race body which is fixed to a body of a sewing machine and has a track groove formed on an inner peripheral portion of the shuttle race body so as to circumferentially elongate in a circumferential direction thereof;

a shuttle body having a track projection elongating in the circumferential direction and being divided in the circumferential direction, formed on an outer peripheral portion, which track projection is fitted into the track groove to rotatably attach the shuttle body to the shuttle race body, and in which a loop-seizing-beak-forming-portion is formed, the loop-seizing-beak-forming-portion including a loop seizing beak formed at a tip end thereof, for seizing a needle thread supplied by a needle which is vertically reciprocated;

a driver which is continuously rotated in synchronization with a vertical motion of the needle in a predetermined rotation direction, for rotating the shuttle body about an axis of the shuttle body by pressing the shuttle body by rotation of the driver; and a bobbin case for accommodating bobbin thread, being detachably attached to the shuttle body, wherein the loop-seizing-beak-forming-portion is formed so as to protrude in a rotation direction of the shuttle body from one circumferential end of the track projection which is placed on a downstream side in the rotation direction of the shuttle body, in the shuttle race body, a protrusion which protrudes in an axial direction of the shuttle race body with facing the track groove is formed, and a recess which elongates in the circumferential direction is formed on a radial outer side of the protrusion, the track projection of the shuttle body has an inner peripheral portion and an outer peripheral portion, the outer peripheral portion more protruding toward an open end of the shuttle body than the inner peripheral portion, a protrusion being formed by the outer peripheral portion, and a recess which elongates in the circumferential direction being formed on a radial inner side of the protrusion, the protrusion of the shuttle race body is fitted into the recess of the track projection of the shuttle body, the protrusion of the shuttle body being fitted into the recess of the shuttle race body, and engaged with the protrusion of the shuttle race body from a radial outer side of the shuttle body, in the outer peripheral portion of the track projection, a projection amount with respect to the inner peripheral portion in regions near circumferential ends is smaller than a projection amount with respect to the inner peripheral portion in a region of a circumferential intermediate portion which is between the regions near the circumferential ends, and the loop seizing beak is formed in a plane including an end face on a side of a shuttle body open end in the region of the circumferential intermediate portion of the outer peripheral portion of the track projection, and the loop-seizing-beak-forming portion which more protrudes toward the shuttle body open end than the regions near the circumferential ends of the outer peripheral portion of the track projection is passed through a recess formed in the needle.

2. The full rotary hook according to claim 1, wherein the shuttle body has a spring member which is fixed in a vicinity of a basal end, and the driver presses a free end of the spring member or a vicinity of the free end.

3. The full rotary hook according to claim 1, wherein a rotation axis of the driver is eccentric with respect to a rotation axis of the shuttle body.

4. The full rotary hook according to claim 1, wherein the shuttle body has a peripheral wall on which the track projection is formed, a needle drop hole is formed in a region of the peripheral wall where the needle is to be inserted toward the shuttle body open end, and an end face which faces the needle drop hole from the bottom of the shuttle body is formed in a same plane as an end face on a side of the shuttle body open end of the outer peripheral portion of the track projection in a region near the loop seizing beak.

* * * * *